United States Patent [19]

Manusch et al.

[11] Patent Number: 4,733,586

[45] Date of Patent: Mar. 29, 1988

[54] METHOD OF AND APPARATUS FOR MAKING A CAPILLARY-ACTION NIB FOR A PEN OR MARKER

[75] Inventors: Christoph Manusch, Hanover; Günter Scholz, Garbsen, both of Fed. Rep. of Germany

[73] Assignee: Pelikan Aktiengesellschaft AG, Hanover, Fed. Rep. of Germany

[21] Appl. No.: 43,159

[22] Filed: Apr. 27, 1987

[30] Foreign Application Priority Data

Apr. 26, 1986 [DE] Fed. Rep. of Germany ..... 3614230

[51] Int. Cl.[4] ..... B26D 3/00

[52] U.S. Cl. ..... 83/39; 83/198; 83/875; 83/448; 401/199; 29/415; 29/557

[58] Field of Search ..... 83/39, 49, 198, 875, 83/444, 448; 401/221, 198, 199; 29/DIG. 20, 557, 415

[56] References Cited

U.S. PATENT DOCUMENTS

| | | | |
|---|---|---|---|
| 371,312 | 10/1887 | Gracey | 29/DIG. 20 |
| 1,356,543 | 10/1920 | Marcq | 29/DIG. 20 |
| 2,463,920 | 3/1949 | Thomas | 29/415 |
| 2,748,769 | 6/1956 | Haber | 29/557 |
| 2,957,226 | 10/1960 | Dibner | 29/415 |
| 4,003,121 | 1/1977 | Hagen et al. | 29/415 |
| 4,361,174 | 11/1982 | Jenkins et al. | 83/198 |
| 4,583,875 | 4/1986 | Manusch et al. | 401/199 |

FOREIGN PATENT DOCUMENTS 2425500 11/1975 Fed. Rep. of Germany .

*Primary Examiner*—E. R. Kazenske
*Assistant Examiner*—Scott A. Smith
*Attorney, Agent, or Firm*—Karl F. Ross; Herbert Dubno

[57] ABSTRACT

A method of and apparatus for the production of wicking tips for pens and markers in which the blanks, pointed at their ends, are first notched on opposite sides and are then cut through between the notches to form two tips from each blank. The invention simplifies the sharpening and dressing required of the tools which are used.

11 Claims, 14 Drawing Figures

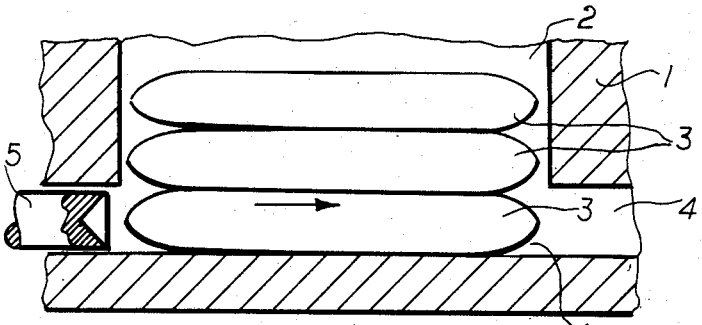
FIG. 1
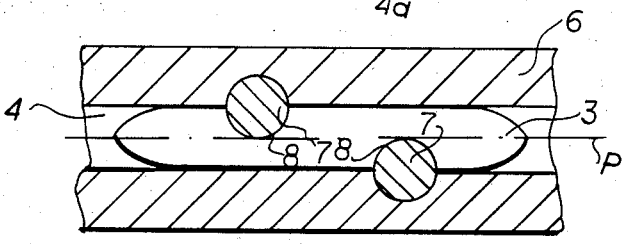
FIG. 2
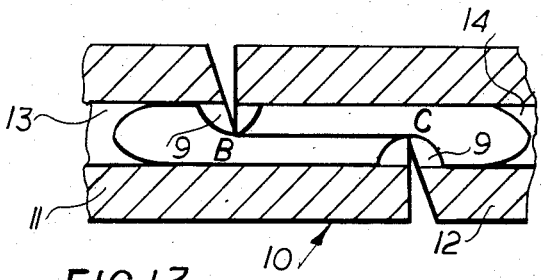
FIG. 3
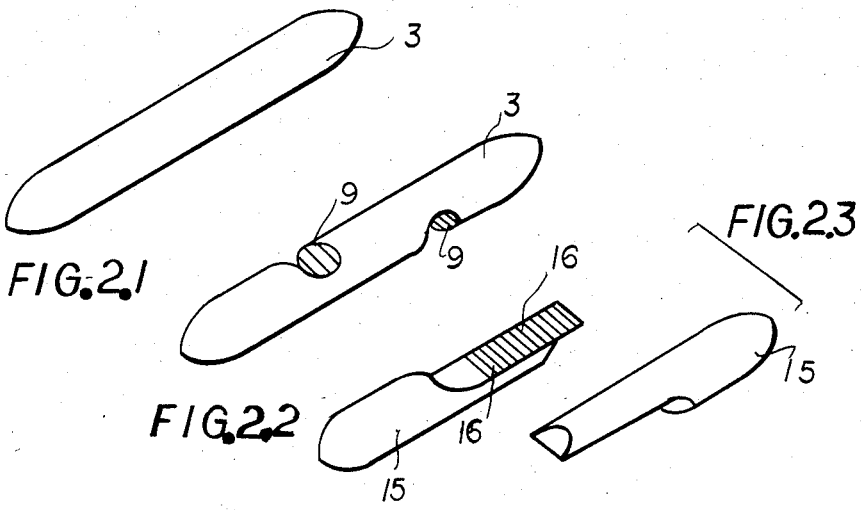
FIG. 2.1
FIG. 2.2
FIG. 2.3

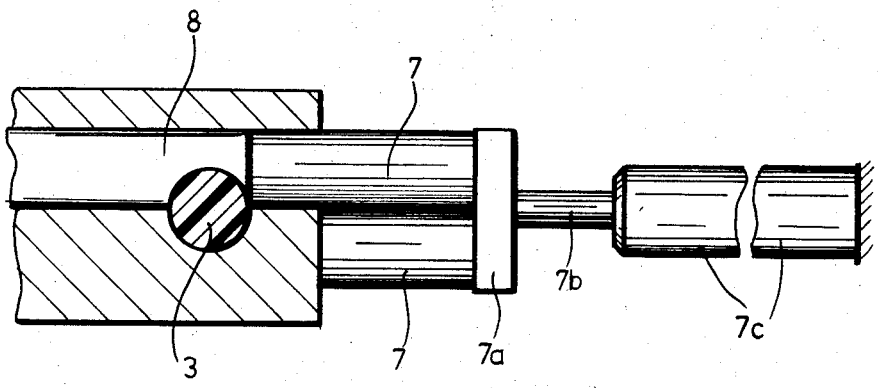
FIG.1.4
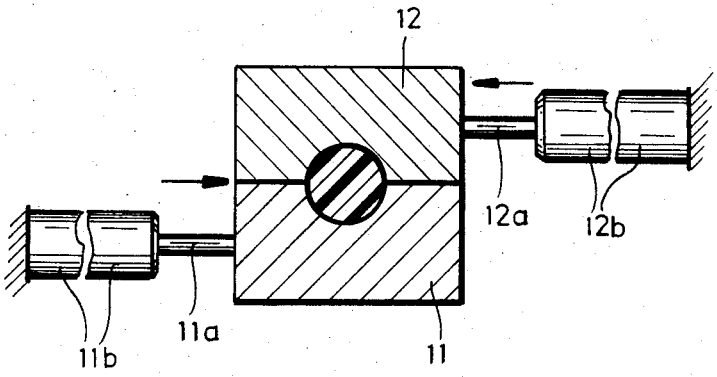
FIG.1.5

METHOD OF AND APPARATUS FOR MAKING A CAPILLARY-ACTION NIB FOR A PEN OR MARKER

FIELD OF THE INVENTION

Our present invention relates to capillary-action nibs or points, also frequently referred to as felt tips, for pens and markers, especially tips which can be cut from an elongated body. More particularly, the invention relates to a method of and an apparatus for making such capillary action tips, nibs or quills.

BACKGROUND OF THE INVENTION

Capillary-action nibs or tips for pens and markers are generally elongated bodies made from a variety of materials, including synthetic resins and felts, and are frequently referred to generically as felt tips even though, in many cases, they are made from materials other than felts and usually have a pointed end and a somewhat blunt end.

Such tips or nibs are anchored in the pen or marker body and communicate with a reservoir for the ink or marker fluid which is delivered by a wicking action of the tip to the point. The tips or nibs are therefore also referred to as wicking tips and, for the purposes of the present description, the terms "capillary-action nibs", "wicking nibs", "wick tips" and "writing wicks" may all be used interchangeably to refer to such tips as operate by a wicking action to draw the ink or other marker fluid to the writing point.

It has been proposed in the past, to fabricate such tips from a blank or workpiece which consists of an elongated body of the material of the tip to be formed which is pointed at its ends and which is then subdivided in a plane generally along the longitudinal axis of the body and so that the tube tips which are formed from each body can then be provided with blunt-end flanks at the end thereof opposite the respective points.

The tip which is thus formed provides a large surface area between the tip and the ink reservoir and thus affords an especially good ink flow.

Another advantage of the earlier method is that by subdividing the blank in the manner described to separate two overlapping regions of the tips which are formed from the single blank, two individual tips are obtained with a total length greater than that of the blank.

The aforedescribed method is the subject of German Patent Document No. 24 25 500 and has the disadvantage that the separating operation, which here utilizes a complex tool to simultaneously form the blunt ends or flanks of the tip, is rather complex and requires complicated sharpening operations which are expensive and must be repeated frequently. Between sharpenings or dressings of the cutting tool, rough edges are left in the tips which are produced.

OBJECTS OF THE INVENTION

It is the principal object of the present invention to provide an improved method of making wicking tips for the purposes described which avoids the drawbacks of the earlier method disclosed in the latter Patent Document and, in general, earlier approaches to the fabrication of such tips.

Still another object of the invention is to provide an improved method which allows the use of relatively simple tools which require a minimum of effort for dressing or sharpening them and, because of the simpler configuration of such tools, permits a more precise production of the writing tips with high dimensional precision and greater reliability with high cutting quality, i.e. freedom from rough edges and surfaces.

Another object of this invention is to provide an improved apparatus for carrying out the method of the invention and, of course, for producing improved capillary-action or wicking tips without the drawbacks of earlier techniques.

SUMMARY OF THE INVENTION

These objects and others which will become apparent hereinafter are attained, in accordance with the invention, in a method which involves in a first step, the notching of the pointed elongated blank at two diametrically and diagonally opposite notches located with point symmetry with respect to one another on opposite sides of a longitudinal median plane through the blank, to thereby form the blunt end flanks of two tips or ribs which are subsequently subdivided from the blank in a second step involving a cut whose parting line or plane extends through the central part of the blank between the notches and extends from one notch to the other.

The method of the invention has the advantage that by carrying out the process in these two steps, standardized cutting and punching tools can be used which can be of simple configuration and easily sharpened and dressed at low cost, requiring less frequent dressing and replacement and providing for longer operating pens and production runs, and cleaner cuts through the blanks.

Because the notches are formed separately, the spacing of the notches from one another is not affected by the dressing of the tools so that the resulting nibs have high dimensional accuracy even over longitudinal production runs and reproducibility, i.e. are identical to one another even after dressing of the cutting surfaces which sever the central portion of the blanks.

The steps of the notches can be selected as desired, although we prefer to form the notches of a generally cylindrical shape. This has the advantage that the tool or tools used to affect the first cutting or punching step may be especially simple.

The diameter of the cylinder of which the notch surfaces can constitute a segment can be equal to or greater than the diameter of the blank so that the end flanks of the parting line or plane will have a sufficiently blunt or obtuse-angle configuration. The depth of the notches is preferably equal to or greater than one-half the diameter of the blank.

The method of the invention can be practiced with a simple device or apparatus, which forms the second aspect of the invention.

The cutting tool or punch for the first cutting stage comprises a passage having the cross section of the blank and through which the blank may be punched. The cross section is preferably cylindrical, but may be prismatic or polygonal, the blank having a corresponding cross section.

A pair of the mutually parallel cylindrical punches enter this passage transversely to the axis thereof and each project into the cross section of the passage from diametrically opposite sides approximately to one-half of the cross section of the passage.

A punching device of this type for forming the notches can be fabricated especially simply and inexpensively and has been found to be insensitive to wear. In fact, the punches require dressing or sharpening only at the end faces so that the spacing of the surfaces which form the flanks of the notches remains unchanged and even after sharpening or dressing.

The punches are synchronously displaced so that the cutting forces can be balanced on the workpiece and a rotation of the workpiece or blank during the cutting operation is avoided.

When a cylindrical blank is used, we may prevent rotation of the blank upon transfer of the latter after notching to the second-stage cutting device. To this end, we may make use of a double blade member in which a pair of blade members laterally engage the blank on opposite sides of the longitudinal median plane thereof as the blank is punched from the first stage tool to the second stage tool.

The double blade member is spring loaded against the blank and can be provided with a stop which prevents it from penetrating excessively into the passage.

With this construction, one or the other blade is always in contact with the blank whether or not a notch is passing and release of the notch which passes so that the blank is securely held against rotation.

Of course, where the blank has a prismatic configuration or polygonal cross section and the passage has a complimentary cross section, the double-blade unit need not be used.

The blade member itself may be held nonrotatably in a guide channel which, like the double blade member, may be prismatic or of polygonal cross section.

The second stage cutting operation is effected utilizing two overlapping cutting plates which are relatively displaced parallel to the plane of overlap and which together define the passage into which the blank is fed so that the longitudinal median plane and axis of the blank lies generally in the contact plane of the overlapping plates.

The length of the overlap of the overlapping plate sections can be equal to the distance between the notches. This cutting tool for the second cutting operation is likewise easily fabricated and maintained, since only a linear cutting cutting edge is formed which may require dressing. The axial length or lengths of overlap need not be maintained within close tolerances.

BRIEF DESCRIPTION OF THE DRAWING

The above and other objects, features and advantages of the present invention will become more readily apparent from the following description, reference being made to the accompanying highly diagrammatic drawing, in which:

FIG. 1.1 is a cross-sectional view through a supply shaft or magazine for feeding the blanks in succession to the upstream end of a passage extending through the two cutting stations of an apparatus in accordance with the invention;

FIG. 1.2 shows the first cutting station in cross section in a plane perpendicular to the plane along which the blank is to be divided to form two wicking writing tips in accordance with the invention;

FIG. 1.3 is a cross section similar to that of FIG. 1.2 through the second cutting station;

FIG. 1.4 is a cross-sectional view taken perpendicular to the median plane and to the cutting plane in FIG. 1.2;

FIG. 1.5 is a view similar to FIG. 1.4, but through the second cutting station of FIG. 1.3;

FIG. 2.1 is a perspective view of a blank before the first punching operation;

FIG. 2.2 is a perspective of the same blank after it has been notched, i.e. following the first punching operation;

FIG. 2.3 is a perspective view of the two tips formed by the second cutting operation;

DESCRIPTION

Figure 3:
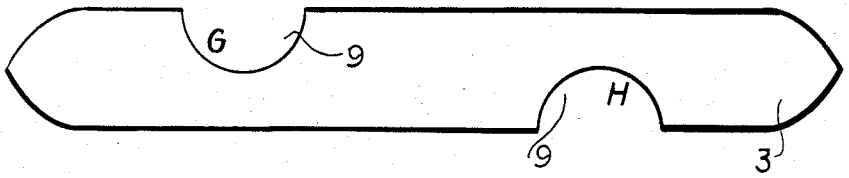
FIGS. 3–6 are enlarged side elevational views of blanks diagrammatically illustrating possible cuts for the second cutting operation to fabricate tips of different shapes.

The cutting apparatus which has been illustrated in FIGS. 1.1–1.5, generally comprises a feed station 1 in the form of a magazine or supply shaft 2 from which a stack of the blanks 3 are fed to a discharge bore 4*a* located at the upstream end of a passage 4 which extends through the two cutting stations and may be provided between these cutting stations with means for preventing rotation of the blanks after they have been notched. The bore has a cross section which corresponds to the cross section of the blanks.

At the opposite side of the stack from the outlet bore 4*a*, there is provided a transport plunger or ram 5 which can be actuated by a reciprocating device not shown and which can advance the blanks to the right one after the other by movement to the right followed by retraction to the left.

The ram can push the blank 3 directly into the portion of the passage 4 which is located at the first cutting or punching station seen in FIG. 1.2. Upon retraction, another blank 3 drops in front of the ram 5 and the process can then be repeated with the blanks being displaced in an end-to-end relationship through the entire apparatus.

In the first cutting station, a cutting tool in the form of a punching die 6 is provided.

The punching die comprises (see FIGS. 1.2 and 1.4) a pair of cylindrical punches 7 whose diameters can be substantially equal to the diameter of the blank 3.

The punches 7 are synchronously displaced, e.g. by mounting them on a common carrier and providing them with a common drive such as the cylinder 7*c* and the piston 7*b*, and are guided in transverse bores 8 formed in the punching die 7.

The bores 8 define a right angle with respect to the guide passage 4 and are disposed in opposed sides of the longitudinal median plane through this bore and the blank 3.

Each of the bores 8 is located at a distance from an end of the blank equal to about one-third of its length so that the distance between the bores 8 is also about one-third of the length of the blank. The axes of the bores 8 are tangential to the wall of the passage 4 which is cylindrical in the case of cylindrical blanks.

When the punches 7 are driven to the left (FIG. 1.4) they punch out notches 9 of cylindrical segmental shape, thereby cutting out pieces which are generally of lens shape.

This can be seen from a comparison of FIGS. 2.1 and 2.2 which respectively show the blank prior to notching and the blank subsequent to notching.

After the notching operation has been completed, the punches 7 are retracted and the notched blank can be displaced out of the die 6 along the passage 4 into a further passage formed by the second cutting station which has been represented in FIG. 1.3.

In the second cutting station, a cutting die 10 is provided which cuts the blank between the notches into two tips and between the two cutting stations along the passage 4 a device can be provided (see FIGS. 7 and 7A) for preventing rotation of the blank when the latter is cylindrical.

The cutting die 10 comprises two oppositely stepped plates 11 and 12 which can be moved relatively in a direction perpendicular to the plane of the drawing in FIG. 1.3. The means for so moving the plates has been shown in FIG. 1.5 to comprise a pair of pistons 11*a* and 12*a*, driven by respective cylinders 11*b*, 12*b*.

Between the edges B and C of these plates 11 and 12, the plates lie in contact with one another.

The distance between the edges B and C correspond generally to the spacing of the notches 9 in the blank 3.

The plates 11 and 12 have channels 13 and 14 which form the passage when they are coaxially in registry and thus, the blank 3 can be fed into the passage defined by the channels 13 and 14 when they are in registry whereupon the plates are shifted laterally relative to one another in the directions represented by the arrows in FIG. 1.5 to sever the nibs from one another (FIG. 2.3) along a printing plane which may correspond to the separating line B-C. The two tips are shown at 15.

The surfaces at which the two tips have been separated from one another has been emphasized by lining in FIG. 2.3.

FIGS. 3–6 show various possibilities for the orientation of the printing plane. For example, in FIG. 3 the notches 9 are cylinder segmental notches with cylinder diameters equal to the diameter of the blank 3 and a notch depth of one-half the blank diameter. The printing plane G-H coincides with the longitudinal median plane of the blank. This cutting pattern may require high precision in the guidance of the two plates and the positioning of the blank.

Figure 4:
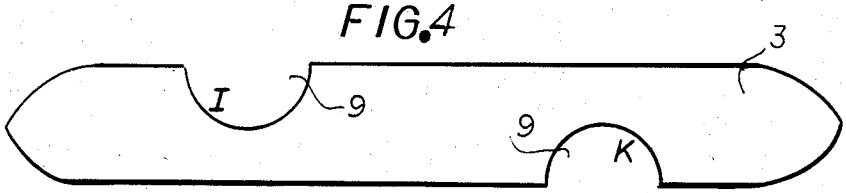

In FIG. 4, we have shown another cutting plane I-K with a similar formation of the notches 9 as has been described in FIG. 3. Slight variations at the point at which the cutting plane enters the notches is tolerable in this pattern and thus one need be less concerned as the accuracy of positioning of the blank in the die and the blank length without deterioration in the quality of the product.

Figure 5:
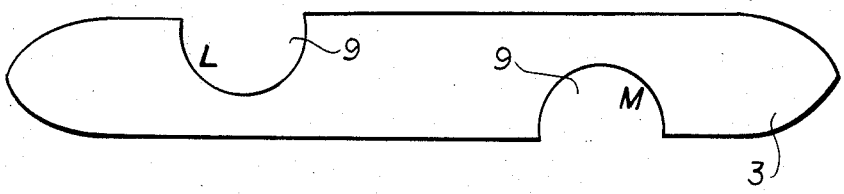
Figure 6:
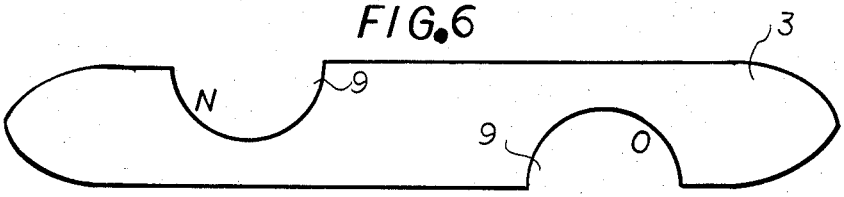

The same advantage applies in the embodiments of FIGS. 5 and 6 where the cutting plane L-M and N-O are at least approximately parallel to the longitudinal median plane or run therealong, but the notches 9 are deeper than half of the diameter of the blank (FIG. 5) and/or are of a larger diameter than the blank (FIG. 6).

Figure 7:
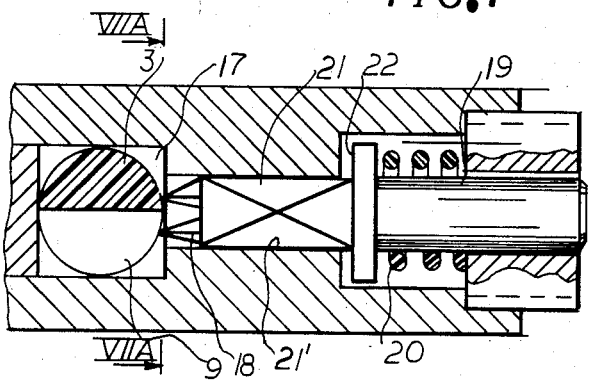
FIG. 7 is a cross-sectional view through the device according to the invention for holding the blank against rotation during its transfer from the first cutting station to the second cutting station, the second plane being parallel to the plan in FIG. 1.4.
Figure 7A:
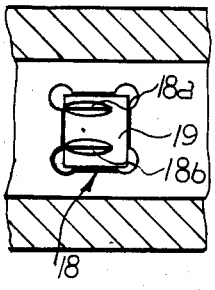
FIG. 7A is a sectional view taken along the line VIIA—VIIA of FIG. 7.

FIGS. 7 and 7A show a device which can be provided between the two cutting stations for preventing rotation of the blank when the blank is cylindrical. When, of course, the blank is of elliptical cross section or a polygonal cross section or any other noncircular cross section, this device need not be used.

The blank between the two stations can be fed through a passage 17 into one side of which a double-blade member 18 projects, the double-blade member 18 being carried on a guide element 19 which is biased toward the passage 17 by a compression coil spring 20.

The guide element 19 has a prismatic portion 21 guided in a correspondingly prismatic bore 21′ to prevent rotation of the double-blade member 18 and to hold the blades thereof parallel to the median plane of the blank 3 and the direction of displacement of the guide element 19.

The guide element 19 is also formed with an abutment 22 which limits the penetration of the blade member 18 into the passage 17.

As the blank 3 is pushed out of the die 6 of the first cutting stage into the passage 17, the rounded point at the leading end of the blank engages the likewise rounded spaced apart blades 18*a* and 18*b* of the double-blade member 18 which slightly cuts into the blank and prevents rotation thereof. The blank 3 can thus be shoved passed the double-blade member 18 into the second cutting station to ensure proper positioning in the latter for the second cutting operation with the notches properly oriented.

We claim:

1. A method of making writing nibs for capillary-action pens and markers, comprising the steps of:

notching an elongated nib blank pointed at opposite ends at locations on opposite sides of a longitudinal median plane through said blank to form end flanks of nibs to be formed from said blank; and thereafter cutting said blank along a parting plane running from one of said notches to the other of said notches, thereby forming two of said writing nibs by a division of said blank.

2. The method defined in claim 1 wherein said notches are segments of cylinders so that said flanks are cylindrical arc segments.

3. The method defined in claim 2 wherein said cylinders have diameters at least equal to a thickness of said blank.

4. The method defined in claim 3 wherein said blank is cylindrical with said thickness equal to the diameter of said cylinders.

5. The method defined in claim 4 wherein said notches have depths at least equal to half the diameter of said blank.

6. An apparatus for making writing nibs for capillary-action pens and markers, comprising:

means for notching an elongated nib blank pointed at opposite ends at locations on opposite sides of a longitudinal median plane through said blank to form end flanks of nibs to be formed from said blank; and means for thereafter cutting said blank along a parting plane running from one of said notches to the other of said notches, thereby forming two of said writing nibs by a division of said blank.

7. The apparatus defined in claim 6 wherein said notching means and said cutting means are disposed along a transport path, further comprising means at an upstream end of said path for feeding a multiplicity of said blanks in succession from a supply shaft along said path to said means for notching.

8. The apparatus defined in claim 7 wherein said means for notching includes a passage traversed by said flanks and extending along an axis of said flanks, and a pair of cylindrical plungers displaceable transversely of said passage to punch said notches into each blank.

9. The apparatus defined in claim 8 further comprising means including a double-edged member projecting into said passage and engageable with said blanks for preventing rotation thereof as said blanks are displaced therepast between said notching means and said cutting means.

10. The apparatus defined in claim 9 wherein said double-edged member has a prismatic shank received in a complementary prismatic guide preventing rotation of said member, further comprising a spring pressing said double-edged member against said blanks, and a stop limiting the displacement of said double-edged member into said passage.

11. The apparatus defined in claim 10 wherein said cutting means includes two overlapping cutting plates defining a bore through which each blank passes and having an overlapping plane generally in the region of the axis of said bore, the length of the mutually overlapping region of said cutting plates being equal substantially the distance between said notches.

* * * * *